US008237114B2

(12) United States Patent
Okuno et al.

(10) Patent No.: US 8,237,114 B2
(45) Date of Patent: Aug. 7, 2012

(54) SAMPLE TARGET USED IN MASS SPECTROMETRY, METHOD FOR PRODUCING THE SAME, AND MASS SPECTROMETER USING THE SAMPLE TARGET

(75) Inventors: Shoji Okuno, Fujiidera (JP); Yoshinao Wada, Minoo (JP); Takashi Yanagishita, Kawasaki (JP); Hideki Masuda, Hachioji (JP)

(73) Assignee: Japan Science & Technology Agency, Saitama (JP)

( * ) Notice: Subject to any disclaimer, the term of this patent is extended or adjusted under 35 U.S.C. 154(b) by 543 days.

(21) Appl. No.: 11/988,166

(22) PCT Filed: Apr. 28, 2006

(86) PCT No.: PCT/JP2006/309032

§ 371 (c)(1),
(2), (4) Date: Jan. 2, 2008

(87) PCT Pub. No.: WO2007/046162

PCT Pub. Date: Apr. 26, 2007

(65) Prior Publication Data

US 2009/0095897 A1 Apr. 16, 2009

(30) Foreign Application Priority Data

Oct. 20, 2005 (JP) ..... 2005-306386

(51) Int. Cl.
*H01J 49/26* (2006.01)

(52) U.S. Cl. ..... 250/288; 250/281; 250/282

(58) Field of Classification Search ..... 250/281, 250/282, 288

See application file for complete search history.

(56) References Cited

U.S. PATENT DOCUMENTS 6,139,713 A 10/2000 Masuda et al.
6,288,390 B1 9/2001 Siuzdak et al.
2002/0005478 A1* 1/2002 Hillenkamp et al. ..... 250/288

(Continued)

FOREIGN PATENT DOCUMENTS

EP 1726944 11/2006

(Continued)

OTHER PUBLICATIONS

Hideki Masuda et al. "Fabrication of Gold Nanodot Array Using Anodic Porous Alumina as an Evaporation Mask." Jpn. J. Appl. Phys. vol. 35, Jan. 15, 1996, pp. L126-L129.

(Continued)

*Primary Examiner* — David A Vanore
*Assistant Examiner* — Nicole Ippolito
(74) *Attorney, Agent, or Firm* — Harness, Dickey & Pierce, P.L.C.

(57) ABSTRACT

In one embodiment of the present invention, a sample target that allows ionization of a substance whose molecular weight is so high as to exceed 10000 in mass spectrometry that ionizes a sample without using matrix, a method for producing the same and a mass spectrometer using the sample target. The sample target includes a sample support surface including a large number of fine pores on its face receiving irradiated laser light. Each of the fine pores has a diameter of 30 nm or more and 5 μm or less. The number indicative of pore depth/(pore cycle−pore diameter) of each of the fine pores is 2 or more and 50 or less. The face of the sample support surface is coated with metal or semiconductor.

14 Claims, 1 Drawing Sheet

U.S. PATENT DOCUMENTS

| | | | | |
|---|---|---|---|---|
| 2002/0121595 | A1 * | 9/2002 | Sunner et al. | 250/281 |
| 2003/0010908 | A1 | 1/2003 | Clark et al. | |
| 2004/0094705 | A1 * | 5/2004 | Wood et al. | 250/288 |
| 2005/0116161 | A1 * | 6/2005 | Hafeman et al. | 250/282 |
| 2006/0214101 | A1 * | 9/2006 | Takahashi et al. | 250/288 |
| 2009/0189064 | A1 * | 7/2009 | Miller et al. | 250/282 |
| 2009/0314936 | A1 | 12/2009 | Okuno | |

FOREIGN PATENT DOCUMENTS

| | | | |
|---|---|---|---|
| JP | 10-121292 | | 5/1998 |
| JP | 2002-285382 | | 10/2002 |
| JP | 2003-43014 | A | 2/2003 |
| JP | 2005-226087 | | 8/2005 |
| WO | WO 2004/047142 | | 6/2004 |
| WO | WO 2004/081555 | * | 9/2004 |
| WO | WO 2005/083418 | | 9/2005 |

OTHER PUBLICATIONS

Kazuyuki Nishio et al. "Ideally Ordered Metal Hole Arrays with High Aspect Ratios Prepared from Anodic Porous Alumina." Jpn. J. Appl. Phys. vol. 42, Jan. 15, 2003, pp. L83-L85.

Hideki Masuda et al. "Fabrication of Porous $TiO_2$ Films Using Two-Step Replication of Microstructure of Anodic Alumina." Jpn. J. Appl. Phys. vol. 31, Dec. 15, 1992, pp. L1775-L1777.

Shoji Okuno et al, "Requirements for Laser-Induced Desorption/Ionization on Submicrometer Structures" Analytical Chemistry, vol. 77, No. 16, Jun. 28, 2005, pp. 5364-5369.

Shoji Okuno, "Matrix-Free Laser Desorption/Ionization on Submicrometer Order Structures—Requisite Factors for Ionization (Submicrometer-Sized no Kozotai ni okeru Matrix-free Laser Datsuri Ionization-Ionization ni Hitsuyo na Mono wa Nani ka?)" Dai 53 Kai Annual Conference on Mass Spectrometry, May 1, 2005, pp. 344-345.

Shoji Okuno et al., "Matrix-Free Laser Desorption/Ionization of Peptides on Sub-micrometer Structures: Grooves on Silicon and Metal-Coated Porous Alumina", 53rd ASMS Conference on Mass Spectrometry and Allied Topics, (San Antonio, Texas, USA), Proceedings (Published on the Internet on Apr. 15, 2005).

Sergey Alimpiev et al., "On the Mechanism of Laser-Induced Desorption-Ionization of Organic Compounds from Etched Silicon and Carbon Surfaces", Journal of Chemical Physics, vol. 115, No. 4, Jul. 22, 2001, pp. 1891-1901.

Nancy H. Finkel et al., "Ordered Silicon Nanocavity Arrays in Surface-Assisted Desorption/Ionization Mass Spectrometry" Analytical Chemistry, vol. 77, No. 4, Feb. 15, 2005, pp. 1088-1095.

"Nanowire-assisted Laser Desorption and Ionization Mass Spectrometry for Quantitative Analysis of Small Molecules", Rapid Communications in Mass Spectrometry, 2005, 19, pp. 3166-3170. Published online in Wiley Interscience.

Japanese Office Action mailed on Sep. 6, 2011 for corresponding Japanese Application No. 2007-540878 (with English translation.

Japanese Office Action mailed Jun. 21, 2011 for corresponding Japanese Application No. 2007-540878 (with English translation).

Yuebo Wang et al., "Porous Anodic Alumina . . . ", Journal of the American Society for Mass Spectrometry, Jul. 14, 2005 (published online), 16, Issue 9, pp. 1488-1492.

* cited by examiner

SAMPLE TARGET USED IN MASS SPECTROMETRY, METHOD FOR PRODUCING THE SAME, AND MASS SPECTROMETER USING THE SAMPLE TARGET

TECHNICAL FIELD

The present invention relates to (i) a sample target used in mass spectrometry, (ii) a method for producing the sample target, and (iii) a mass spectrometer using the sample target. Particularly, the present invention relates to (a) a sample target which allows ionization of a sample without using any matrix, (b) a method for producing the sample target, and (c) a mass spectrometer using the sample target.

BACKGROUND ART

Mass spectrometry is an analysis in which a sample is ionized and a ratio of a mass of a sample or sample fragment ions to electric charge (hereinafter, the ratio is referred to as "m/z value") is measured so as to analyze a molecular weight of the sample. As the mass spectrometry, there is known matrix-assisted laser desorption/ionization mass spectrometry (MALDI) in which a low molecular weight organic compound referred to as a matrix is mixed with a sample and laser is irradiated to the mixture so as to ionize the sample. According to the method, laser energy absorbed in the matrix is transmitted to the sample, so that it is possible to ionize the sample satisfactorily.

MALDI allows ionization of a thermally instable substance and a polymer substance, so that this method allows "softer" ionization of the sample than other ionization techniques. Therefore, this method is widely adopted for mass spectrometry of various substances such as biopolymer, endocrine disrupter, synthetic polymer, metallic complex, and the like.

However, MALDI uses an organic compound matrix, and as a result it may be difficult to analyze sample ions due to related ions derived from the matrix. Specifically, in case where the organic compound matrix is used, there are observed matrix-related ions such as (i) matrix molecule ions, (ii) cluster ions caused by hydrogen bond of matrix molecules, (iii) fragment ions generated by decomposition of matrix molecules, and as a result it is often difficult to analyze the sample ions.

As such, various techniques for avoiding disturbance of the matrix-related ions have been conventionally proposed. Specifically, there is known a technique in which the matrix molecules are fixed so as not to generate the matrix-related ions. For specific example, there is disclosed a technique in which a matrix such as a-cyano-4-hydroxy cinnamic acid and cinnamamide is fixed to sepharose beads. Further, there is disclosed a technique in which a self-assembled monomolecular membrane of methyl-N-(4-mercaptophenyl-carbamate) serving as a matrix is formed on a surface of gold that is a target. Furthermore, there is disclosed a technique in which 2,5-dihydroxy benzoic acid (DHB) serving as a matrix is fixed in a silicon polymer sheet through sol-gel processing. However, the method in which the matrix molecules are fixed in the foregoing manner raises such a problem that detection sensitivity and durability are insufficient in practical use. Further, the method also raises such a problem that it is impossible to avoid a noise caused by the fragment ions.

For that reason, a technique using no matrix has been proposed recently. Specifically, there is disclosed a technique in which a semiconductor substrate having porous surfaces (in the document, referred to as "porous light-absorbing semiconductor substrate) is used as a sample target (see Patent Document 1 for example). The sample target is obtained by treating a sample support surface of the semiconductor substrate so that the sample support surface has a porous structure, i.e., a finely bumpy structure. This Document reports that: in case where laser light is irradiated to a sample applied to the sample support surface, a high molecular weight substance is ionized even when there is no matrix. This method is referred to as "DIOS" (Desorption/Ionization on Porous Silicon).

Further, the inventors of the present invention found a technique that allows ionization without using any matrix. According to the technique, by adopting (i) a sample target having as a sample support surface a surface having a finely and regularly bumpy structure of an order ranging from nanometer to several dozen micrometer which is produced by lithography or (ii) a sample target having a sample support surface whose face with a finely bumpy structure of an order ranging from nanometer to several dozen micrometer is coated with metal, it is possible to improve ionization efficiency and stabilize ionization compared with the conventional technique using no matrix (see Patent Document 2 for example).

Further, the inventors of the present invention studied a sample target having, as a sample support surface, a surface made of various materials each having a bumpy structure of a submicrometer order, and they found it possible to carry out ionization without any matrix also by using, as one of the aforementioned materials, a sample support surface that is obtained by coating porous alumina with gold or platinum (see Non Patent Document 1 for example).

Patent Document 1

U.S. Pat. No. 6,288,390 (published on Sep. 11, 2001)

Patent Document 2

International Publication No. 2005/083418 Pamphlet (published on Sep. 9, 2005)

Non-Patent Document 1

Shoji Okuno, Ryuichi Arakawa, Kazumasa Okamoto, Yoshinori Matsui, Shu Seki, Takahiro Kozawa, Seiichi Tagawa, Yoshinao Wada, Matrix-free laser desorption/ionization of peptides on sub-micrometer structures: Grooves on silicon and metal-coated porous alumina, 53rd ASMS Conference on Mass Spectrometry and Allied Topics, (San Antonio, Tex., USA), Proceedings (Published on the Internet on Apr. 15, 2005)

DISCLOSURE OF INVENTION

Problems to be Solved by Invention

However, according to the conventional laser desorption/ionization mass spectrometry without matrix, it is impossible to ionize a substance whose molecular weight is so high as to exceed 10000.

That is, the laser desorption/ionization mass spectrometry based on the conventional DIOS disclosed in Patent Document 1 and the like is effective in ionizing a substance whose molecular weight is 3000 or less but does not allow ionization of the substance whose molecular weight exceeds 10000.

Further, even in case of irradiating laser without using any matrix while using a sample target having a sample support surface having a regularly bumpy structure produced through lithography disclosed in Patent Document 2 or a sample target having a sample support surface obtained by coating a finely bumpy surface with metal, it is impossible to ionize the substance whose molecular weight is so high as to exceed 10000.

The present invention was made in view of the foregoing problems, and an object of the present invention is to provide (i) a sample target which allows ionization of a sample whose molecular weight is so high as to exceed 10000 without using any matrix and a method for producing the same and (ii) a mass spectrometer using the sample target.

Means to Solve the Problems

In order to solve the foregoing problems, a sample target of the present invention is a sample target used to support a sample in ionizing the sample through laser light irradiation so as to carry out mass spectrometry of the sample, the sample target including a sample support surface having a large number of fine pores on its face receiving the irradiated laser light, each of the fine pores having a diameter of 30 nm or more and less than 5 μm, the number indicative of pore depth/(pore cycle−pore diameter) of each of the fine pores being 2 or more and 50 or less, and the face of the sample support surface being coated with metal or semiconductor. It is preferable that the sample support surface is made of porous alumina. It is preferable that the metal is at least one of platinum (Pt) and gold (Au). It is preferable that the semiconductor is at least one of tin oxide ($SnO_2$), zinc oxide (ZnO), indium tin oxide (ITO), and carbon.

In order to solve the foregoing problems, a sample target of the present invention is a sample target used to support a sample in ionizing the sample through laser light irradiation so as to carry out mass spectrometry of the sample, the sample target including a sample support surface having a large number of fine pores on its face receiving the irradiated laser light, the sample support surface being formed in such a manner that a negative structure is formed by transferring a bumpy structure of the porous alumina using the porous alumina as a mold, and the bumpy structure is transferred using the negative structure as a mold, so that the sample support surface has at its face a bumpy structure having a same shape as that of the bumpy structure of the porous alumina.

It is preferable that the sample support surface is made of metal or semiconductor. Further, the face of the sample support surface may be coated with metal or semiconductor. Further, it is preferable that each of the fine pores has a diameter of 30 nm or more and less than 5 μm, and the number indicative of pore depth/(pore cycle−pore diameter) of each of the fine pores is 2 or more and 50 or less. Further, It is preferable that the metal is at least one of platinum (Pt) and gold (Au). It is preferable that the semiconductor is at least one of tin oxide ($SnO_2$), zinc oxide (ZnO), indium tin oxide (ITO), and carbon.

In order to solve the foregoing problems, a sample target of the present invention is a sample target used to support a sample in ionizing the sample through laser light irradiation so as to carry out mass spectrometry of the sample, the sample target including as a sample support surface a surface having a finely bumpy structure in which an interval between concaves and an interval between convexes range from 1 nm to 10 μm and a depth of each concave ranges from 10 nm to 10 μm, the sample support surface having a face coated with semiconductor. It is preferable that the semiconductor is at least one of tin oxide ($SnO_2$), zinc oxide (ZnO), indium tin oxide (ITO), and carbon.

In order to solve the foregoing problems, a method of the present invention is a method for producing a sample target used to support a sample in ionizing the sample through laser light irradiation so as to carry out mass spectrometry of the sample, the sample target having a sample support surface having a large number of fine pores on its face receiving the irradiated laser light, the method comprising the step of coating the face of the sample support surface with metal or semiconductor, the sample support surface being made of porous alumina.

In order to solve the foregoing problems, a method of the present invention is a method for producing a sample target used to support a sample in ionizing the sample through laser light irradiation so as to carry out mass spectrometry of the sample, the sample target having a sample support surface having a large number of fine pores on its face receiving the irradiated laser light, the method comprising the steps of: forming a negative structure by transferring a bumpy structure of porous alumina using the porous alumina as a mold; and forming the sample support surface by transferring the bumpy structure of the porous alumina using the negative structure as a mold, so that the sample support surface has at its face a bumpy structure having a same shape as that of the bumpy structure of the porous alumina. It is preferable that the sample support surface is made of metal or semiconductor. The method may be arranged so as to further include the step of coating the face of the sample support surface with metal or semiconductor. It is preferable that each of the fine pores of the porous alumina has a diameter of 30 nm or more and less than 5 μm, and the number indicative of pore depth/(pore cycle−pore diameter) of each of the fine pores is 2 or more and 50 or less.

In order to solve the foregoing problems, a mass spectrometer of the present invention uses the sample target. It is preferable that, in the mass spectrometer, laser light is irradiated to a sample to be analyzed and the sample is ionized, so that molecular weight of the sample is determined.

Effect of the Invention

As described above, the sample target of the present invention includes the sample support surface having a large number of fine pores on its face receiving the irradiated laser light, each of the fine pores having a diameter of 30 nm or more and less than 5 μm, pore depth/(pore cycle−pore diameter) of each of the fine pores is 2 or more and 50 or less, and the face of the sample support surface is coated with metal or semiconductor. Therefore, the sample target allows ionization of a substance whose molecular weight exceeds 10000 even in case of using no matrix in mass spectrometry.

In case of using porous alumina as the sample support surface, it is possible to easily form an orderly bumpy structure in which pore diameter is 30 nm or more and less than 5 μm and pore depth/(pore cycle−pore diameter) is 2 or more and 50 or less. Further, by selecting the condition for anodization, it is possible to control the pore diameter, the pore depth, and the pore cycle.

Further, as described above, the mass spectrometer of the present invention includes the sample target. Therefore, the mass spectrometer allows ionization of a substance whose molecular weight exceeds 10000 even in case of using no matrix in mass spectrometry.

As described above, the sample target of the present invention includes the sample support surface that is obtained in such a manner that a negative structure is formed by transferring a bumpy structure of porous alumina using the porous alumina as a mold, and the bumpy structure is transferred using the negative structure as a mold, so that the sample support surface has on its face a bumpy structure having the same shape as that of the bumpy structure of the porous alumina. This allows the sample support surface having the same structure as porous alumina having a bumpy structure suitable for a sample support surface to be formed using a desired material. In case where the sample support surface is made of metal or semiconductor, it is possible to increase ionization ability even when ionization using no matrix is carried out in mass spectrometry. Further, in case where the sample support surface is made of a material having no electro-conductivity, coating the face of the sample support surface allows increasing ionization ability. Further, in case where the sample support surface has fine pores each of which has a diameter of 30 nm or more and less than 5 μm and pore depth/(pore cycle−pore diameter) is 2 or more and 50 or less, it is possible to ionize a substance whose molecular weight is high.

As described above, the sample target of the present invention includes the sample support surface in which the interval between concaves or between convexes ranges from 1 nm to 10 μm and the depth of each concave ranges from 10 nm to 10 μm, and the face of the sample support surface is coated with semiconductor. Therefore, it is possible to increase ionization efficiency even when ionization using no matrix is carried out in mass spectrometry. As described above, the mass spectrometer of the present invention includes the sample target. Therefore, it is possible to increase ionization efficiency even when ionization using no matrix is carried out in mass spectrometry.

As described above, the method of the present invention for producing the sample target includes the steps of: anodizing aluminum or its alloy so as to obtain porous alumina as a sample support surface; and coating the face of the sample support surface thus obtained with metal or semiconductor. Therefore, it is possible to easily form an orderly fine pore structure suitable for a sample support surface. Further, by selecting the condition for anodization, it is possible to control pore diameter, pore depth, and pore cycle.

As described above, the method of the present invention for producing the sample target includes the steps of: forming a negative structure by transferring a bumpy structure of porous alumina using the porous alumina as a matrix; and forming a sample support surface by transferring the bumpy structure using the negative structure as a mold so that the sample support surface has on its face a bumpy structure having the same shape as that of the bumpy structure of the porous alumina. This allows the sample support surface having the same structure as porous alumina having a bumpy structure suitable for a sample support surface to be made using a desired material.

For a fuller understanding of the nature and advantages of the invention, reference should be made to the ensuing detailed description taken in conjunction with the accompanying drawings.

BRIEF DESCRIPTION OF DRAWINGS

FIG. 1(*b*) is a cross sectional view taken along a broken line B of the sample target of FIG. 1(*a*), schematically illustrating the sample target of the present invention.

REFERENCE NUMERALS

Figure 1A:
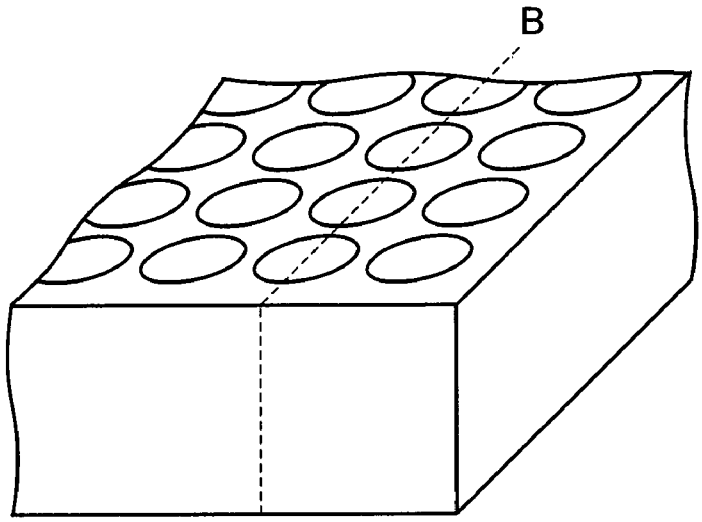
FIG. 1(*a*) is an oblique view of a part of a sample target, schematically illustrating the sample target of the present invention.

101 Porous alumina layer
102 Aluminum (or alloy thereof) layer
103 Barrier layer

BEST MODE FOR CARRYING OUT THE INVENTION

The following describes the present invention in detail, but the present invention is not limited to the following descriptions.

The inventors of the present invention diligently studied in order to solve the foregoing problems. As a result, they found that: a sample target having as a sample support surface a conventional surface with a finely and regularly bumpy structure does not allow ionization of a substance whose molecular weight is high, but a sample target having porous alumina as a sample support surface allows ionization of a substance whose molecular weight is so high as to exceed 10000. Further, the conventional sample support surface has a shallow concave, but porous alumina has a deep concave. Consequently, the inventors considered if the depth of the concave is in any relation to a molecular weight that allows ionization, and studied this by changing depths and intervals of concaves. As a result, the inventors found for the first time that: in order to actually ionize a substance whose molecular weight is high in carrying out ionization without using any matrix, it is important to appropriately set a ratio of a depth of each concave to an interval of concaves adjacent to each other in a bumpy structure of a sample support surface. In this way, the inventors completed the present invention.

That is, a sample target (A) of the present invention is a sample target that is used to support a sample in ionizing the sample through laser irradiation so as to carry out mass spectrometry of the sample, and that includes a sample support surface having a large number of fine pores on its face receiving the irradiated laser light. A diameter of each pore is 30 nm or more and less than 5 μm and the number indicative of pore depth/(pore cycle−pore diameter) of each pore is 2 or more and 50 or less, and the face of the sample support surface is coated with metal or semiconductor.

Note that, as described above, according to the laser desorption/ionization using no matrix which is disclosed in Patent Document 1 and the like, it is impossible to ionize a substance whose molecular weight is so high as to exceed 10000. A main factor thereof is as follows: if energy of laser irradiated to ionize the substance whose molecular weight is high is enhanced, a fine structure of porous silicon is broken. This may be caused not only by a material influence of silicon but also by a structurally low strength due to difficulty in controlling a bumpy structure of porous silicon.

Recently, in a nano technology field, there has been developed a technique for producing a new fine structure through "imprint" processing in which a fine structure of an order ranging from 1 nm to several dozens μm is used as a mold and the structure is transferred to another substance, thereby producing a DNA chip, a semiconductor device, and a fine vessel for chemical reaction.

The inventors of the present invention focused attention on the "imprint" technique and considered if it was possible to apply the "imprint" technique to a surface treatment of a sample target used in the laser desorption/ionization mass spectrometry by way of transferring using porous alumina as a mold. If porous alumina is used as the mold and a treatment is carried out in accordance with the "imprint" technique, it is possible to more stably and highly precisely treat a fine structure of an order ranging from several nm to several dozens μm with a higher aspect ratio than a fine structure produced by using porous silicon or by adopting lithography in accordance with the conventional method. Therefore, if the aforementioned fine treatment technique is actually adopted, it is possible to stably form an orderly bumpy shape on the face of the sample support surface. Further, the inventors found it possible to stably produce a sample target having favorable quality by using metal or semiconductor as a material to be transferred or by coating with metal or semiconductor the surface of the fine structure to which the foregoing material had been transferred.

Thus, the present invention includes a sample target having the fine structure formed by using porous alumina as a mold and transferring the porous alumina in accordance with the imprint technique. That is, the present invention also includes a sample target (B) that is used to support a sample in ionizing the sample through laser irradiation so as to carry out mass spectrometry of the sample, and that has a sample support surface having a large number of pores on its face receiving the irradiated laser. The sample support surface has a bumpy structure that is obtained in such a manner that a negative structure is formed by transferring a bumpy structure of porous alumina using the porous alumina as a mold and the bumpy structure of the porous alumina is transferred using the negative structure as a mold, so that the sample support surface has on its face a bumpy structure having the same shape as the bumpy structure of the porous alumina.

Further, the present invention includes a sample target (C) that is used to support a sample in ionizing the sample through laser irradiation so as to carry out mass spectrometry of the sample, and that includes a sample support surface having such a fine structure that an interval of concaves or convexes ranges from 1 nm to 10 μm and a depth of each concave ranges from 10 nm to 10 μm, a face of the sample support surface being coated with semiconductor.

Mechanism of ionization in the conventional laser desorption/ionization mass spectrometry using no matrix, e.g., in DIOS and the like is not clear. Also, mechanism of ionization in the sample target of the present invention is not clear. However, both of them have nano structures, and therefore the mechanism may be based on occurrence of a local electromagnetic field at the nano structure face caused by the light irradiation. Further, because of the porous structure, the sample support surface has a greatly expanded area than a flat surface. This also contributes to the mechanism. Further, water or acid of the sample solvent is stored by the pores, and proton required in the ionization may be generated therefrom.

Further, unlike DIOS, in the sample target of the present invention, it is possible to ionize molecules whose molecular weight exceeds 10000 (e.g., protein). What allows the ionization in the sample target of the present invention is not clear but may be as follows. That is, not only in ionization according to DIOS but also in ionization using the sample target of the present invention, laser intensity required in the ionization is in proportion to a size of a sample molecule. Thus, it is necessary to irradiate intense laser to the sample face in ionizing a molecule whose molecular weight is large, but in DIOS, the sample support surface cannot withstand the intense laser and as a result the nano structure thereof is broken, which prevents the ionization ability from being exhibited. In contrast, the sample target of the present invention has sufficiently durable structure against such intense laser, and as a result it is possible to carry out the ionization.

As to the sample target of the present invention, the method of the present invention for producing the sample target, and the mass spectrometer of the present invention using the sample target, the following sequentially describes (I) Sample target (A), (II) Sample target (B), (III) Sample target (C), and (IV) Usage of the present invention (mass spectrometer).

(I) Sample Target (A)

(I-1) Sample Target (A)

The sample target of the present invention is used in a laser desorption ionization mass spectrometer which ionizes a sample by irradiating laser light so as to carry out mass spectrometry of the sample, and the sample target serves as a sample table on which a sample to be analyzed is placed.

The sample target has a sample support surface on which a sample is supported. Portions of the sample target other than the sample support surface are not particularly limited in terms of their arrangement, their shape, their material, and the like.

Examples of the material for the sample support surface include semiconductor, metal, resin such as synthetic polymer, ceramics, and a composite containing these materials in plurality. Specific examples of the composite include: a multilayer structure in which a semiconductor film is formed on a surface of a metal layer; a multilayer structure in which a semiconductor film is formed on a surface of a resin layer; a multilayer structure in which a semiconductor film is formed on a surface of ceramics; and the like. However, the composite is not limited to them.

The sample support surface of the sample target of the present invention is a face supporting a sample to be analyzed and receives irradiated laser light while supporting the sample.

The sample target of the present invention includes the sample support surface having a large number of pores in its front side receiving the irradiated laser light. The pores have openings on the sample support surface and extend in a thickness direction of the sample support surface. The positioning of the pores, the shapes of the pores, and the angles of the pores with respect to the sample support surface may be regular or irregular, but these are preferably regular in order to further improve the function as the sample target for mass spectrometry.

Figure 1B:
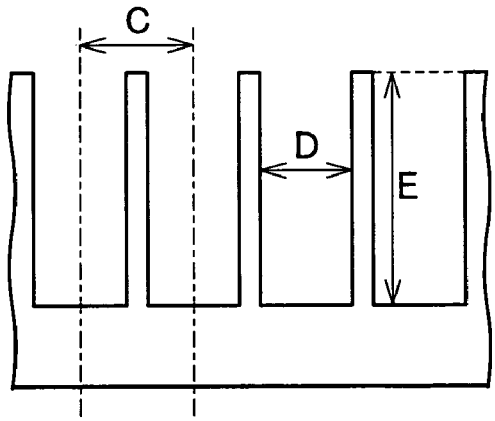

An example of the sample support surface of the sample target of the present invention is schematically illustrated in FIGS. 1(*a*) and 1(*b*). Note that, each of FIGS. 1(*a*) and 1(*b*) illustrates the sample support surface which has not been coated with metal or semiconductor. FIG. 1(*a*) is an oblique view of a part of the sample support surface of the sample target. FIG. 1(*b*) is a cross sectional view of the sample support surface taken along a broken line B of FIG. 1(*a*). The sample support surface illustrated in FIGS. 1(*a*) and 1(*b*) is such that the positioning of the pores, the shapes of the pores, and the angles of the pores with respect to the sample support surface are regular. The sample support surface has a large number of pores on its face receiving the irradiated laser light, i.e., on a top face of FIG. 1(*a*). As illustrated in FIG. 1(*b*), each of the pores extends from the top face of the sample support surface in the thickness direction of the sample support surface and has a bottom.

Further, the shape of a cross section of the pore cross-sectioned in a direction parallel to the sample support surface is not particularly limited and may be circular, oval, or polygonal such as triangular, quadrangular, pentagonal, hexagonal, and the like. These shapes may be little bit deformed. The shapes may be regular or irregular. That is, it is not necessary that all the parts of the sample support surface have a single shape. However, in order to further improve the function as the sample target for mass spectrometry, the cross sectional shapes are preferably regular, i.e., identical with each other. Also, in order to further improve the function as the sample target for mass spectrometry, the cross sectional shapes are preferably constant from the opening of the pore to the bottom, but may be little bit deformed.

Further, the pore may be arranged in any manner as long as the pore extends from the top face of the sample support surface in the thickness direction, and it is preferable that the pore extends in a vertical direction with respect to the top face of the sample support surface, but the extending direction of the pore may little bit slant. Further, the pores may be different from each other in terms of the angle between each pore and the top face of the sample support surface, but angles are preferably regular. That is, it is preferable that the pores extend in the same direction. Thus, it is possible to further improve the function as the sample target. Further, it is preferable that the pore linearly extends from the opening to the bottom. In case where the pore does not linearly extend, the laser light does not reach the inside of the pore, and as a result the ionization is less efficiently carried out. Thus, it is not preferable that the pore does not linearly extend.

Further, it is preferable that a pore diameter is 30 nm or more and less than 5 μm and pore depth/(pore cycle−pore diameter) is 2 or more and 50 or less. This allows ionization of a substance whose molecular weight exceeds 10000. Herein, the pore diameter is a largest size of a cross section in a direction parallel to the top face of the sample support surface. In case where the cross section has a circular shape, the pore diameter corresponds to a diameter of the cross section. In FIG. 1(*b*), this is indicated by a portion "D". Further, the pore depth is a length of the pore extending from the opening to the bottom. In FIG. 1(*b*), this is indicated by a portion "E". Further, the pore cycle is an interval between centers of pores adjacent to each other. In FIG. 1(*b*), this is indicated by a portion "C". Note that, in FIG. 1(*b*), a dashed line corresponds to a centerline of the pore. In case where the pore diameters, the pore depths, and the pore cycles are not uniform, average values are used for these values, respectively. Note that, the cross sectional view illustrated in FIG. 1(*b*) is such a cross section whose portion "D" is largest. For example, in case where the cross section of the pore cross-sectioned in a direction parallel to the sample support surface has a cyclic shape, the cross sectional view in FIG. 1(*b*) includes a cross section having the diameter of the cyclic shape.

The pore cycle or the pore diameter is 1 nm to several dozens μm. However, in order to further improve the function as a sample target for mass spectrometry, the pore cycle is preferably 30 nm or more and less than 5 μm, more preferably from 31 nm or more and 1 μm, further more preferably from 33 nm to 500 nm, most preferably from 34 nm to 300 nm. Further, the pore diameter is preferably 30 nm or more and less than 5 μm, more preferably 40 nm or more and 1 μm, further more preferably 45 nm to 700 nm, most preferably 50 nm to 500 nm. This allows satisfactory ionization of a sample to be analyzed in mass spectrometry.

Further, the pore cycles and the pore diameters may be regular or irregular. However, in order to further improve the function as the sample target for mass spectrometry, the pore cycles and the pore diameters are preferably regular. That is, it is preferable that the pore cycles and the pore diameters are uniform. In case where the pore cycles and the pore diameters are regular, variations in concaves and convexes of the sample support surface are small, so that the ionization ability is further stabilized.

Further, the pore depth is 30 nm or more and less than 5 μm. However, in order to further improve the function as the sample target for mass spectrometry, the pore depth preferably ranges from 30 nm to 2 μm, more preferably from 50 nm to 1.5 μm, further more preferably from 70 nm to 1 μm, most preferably from 100 nm to 1 μm. Further, the pore depths may be regular or irregular. That is, the pore depths may be uniform or not uniform. However, in order to further improve the function as the sample target for mass spectrometry, it is preferable that the pore depths are uniform. In case where the pore depths are uniform, variations in concaves and convexes of the sample support surface are small, so that the ionization ability is further stabilized.

Further, the value indicative of pore depth/(pore cycle−pore diameter) preferably ranges from 2 to 50, more preferably from 2.5 to 45, further preferably from 3 to 35, further more preferably from 3.5 to 30, and most preferably from 4 to 25. As a result, even in case of using no matrix in the mass spectrometry, it is possible to satisfactorily ionize a substance whose molecular weight exceeds 10000.

In case where the value indicative of pore depth/(pore cycle−pore diameter) is so large as to exceed 50, a structure of the convex is weak and as a result the structure is likely to be broken, and laser light does not reach the inside of the pore and as a result it is impossible to carry out the ionization. Further, in case where the value indicative of pore depth/(pore cycle−pore diameter) is so small as to be less than 2, the ionization is not efficiently carried out and as a result it is impossible to ionize a substance whose molecular weight is high.

Note that, in case of such a structure that pores are irregularly provided, the value indicative of pore depth/(pore cycle−pore diameter) is an average value of an entire portion in which pores are disposed (porous portion). The value indicative of pore depth/(pore cycle−pore diameter) is calculated without considering a partial and great defect.

Further, in the sample target of the present invention, a face of the sample support surface is coated with metal or semiconductor. As a result, it is possible to improve the ionization ability, thereby ionizing a substance whose molecular weight is high even in case of using no matrix.

Specific examples of the metal with which the sample support surface is coated include: the periodic table's 1A group (Li, Na, K, Rb, Cs, Fr); 2A group (Be, Mg, Ca, Sr, Ba, Ra); 3A group (Sc, Y); 4A group (Ti, Zr, HO; 5A group (V, Nb, Ta); 6A group (Cr, Mo, W); 7A group (Mn, Tc, Re); 8 group (Fe, Ru, Os, Co, Rh, Ir, Ni, Pd, Pt); 1B group (Cu, Ag, Au); 2B group (Zn, Cd, Hg); 3B group (Al); lanthanoid (La, Ce, Pr, Nd, Pm, Sm, Eu, Gd, Tb, Dy, Ho, Er, Tm, Yb, Lu); actinoid (Ac, Th, Pa, U, Np, Pu, Am, Cm, Bk, Cf, Es, Fm, Md, No, Lr); and the like. Above all, it is preferable to use Au or Pt as the aforementioned metal. Au and Pt are hard to oxidize, so that it is possible not only to improve the ionization efficiency but also to prevent oxidization of the sample support surface having a large number of pores. Further, as the metal, the above-mentioned metals may be independently used, or an alloy consisting of two or more kinds of the above-mentioned metals may be used. Herein, a form of the alloy consisting of two or more kinds of metals is not particularly limited as long as two or more kinds of metals are mixed with each other. Examples of the form of the alloy consisting of two or more kinds of metals mixed with each other include: a solid solution; an intermetallic compound; a form in which a solid solution and an intermetallic compound are mixed with each other; and the like.

Further, the face of the sample support surface may be coated with plural layers each made of plural metals selected from the above-mentioned metals.

Further, the semiconductor with which the sample support surface is coated is not particularly limited. Specific examples of the semiconductor include Si, Ge, SiC, GaP, GaAs, InP, $Si_{1-x}Ge_x$ ($0<x<1$), $SnO_2$, ZnO, $In_2O_3$, combinations thereof, and carbon. More preferable examples of the semiconductor include $SnO_2$, ZnO, $In_2O_3$, and ITO that is a composite of $SnO_2$ and $In_2O_3$. These materials are oxides and are not oxidized any more, and therefore do not decrease ionization ability even when the materials are left in the air. Further, carbon has different physical properties depending on its combined state of atoms. Here, carbon is classified as semiconductor. Carbon is less likely to be oxidized in the air, too. Therefore, carbon does not decrease ionization ability even when carbon is left in the air.

Further, it is preferable that the face of the sample support surface is coated with a composite consisting of at least two materials selected from the above-mentioned semiconductors and the above-mentioned metals.

The thickness of the metal and/or the semiconductor with which the face of the sample support surface is coated is not particularly limited as long as the thickness does not impair the bumpy structure of the sample support surface having a large number of fine pores. Specifically, the thickness ranges preferably from 1 nm or more to 200 nm or less for example. In case where the thickness is not more than the upper limit, the bumpy structure of the sample support surface is not impaired. In case where the thickness is more than the lower limit, it is possible to perform effective ionization. The thickness ranges more preferably from 1 nm or more to 150 nm or less, further preferably from 5 nm or more to 100 nm or less, further more preferably from 10 nm or more to 80 nm or less, and most preferably from 20 nm or more to 75 nm or less. This allows further effective ionization.

The material of the sample support surface is not particularly limited as long as the material has the aforementioned shape. Examples of the material include resin such as a synthetic polymer and ceramics. Even in case where the material does not have electro-conductivity, coating the material with metal and/or semiconductor increases efficiency in ionization.

Examples of the synthetic polymer include polyethylene, polypropylene, polyacrylic ester, polymethacrylic ester, polystyrene, polysiloxane, polystanoxane, polyamide, polyester, polyaniline, polypyrrole, polythiophene, polyurethane, polyethyletherketone, poly 4-ethylene fluoride, copolymers thereof, combinations thereof, graft polymers thereof, and block polymers thereof.

Examples of the ceramics include alumina (aluminum oxide), magnesia, beryllia, zirconia (zirconium oxide), uranium oxide, thorium oxide, silica (quartz), forsterite, steatite, wollastonite, zircon, mullite, cordierite, spodumene, aluminum titanate, spinel, apatite, barium titanate, ferrite, lithium niobate, silicon nitride, sialon, aluminum nitride, boron nitride, titanium nitride, silicon carbide, boron carbide, titanium carbide, tungsten carbide, lanthanum boride, titanium boride, zirconium boride, cadmium sulfide, molybdenum sulfide, molybdenum silicide, diamond, and monocrystal sapphire.

The material of the sample support surface may be metal or semiconductor. In that case, it is not necessarily required to coat the sample support surface with metal and/or semiconductor. Examples of the metal and the semiconductor to be used as the material of the sample support surface are the same as the aforementioned examples of the metal and the semiconductor with which the sample support surface is coated.

Figure 2:
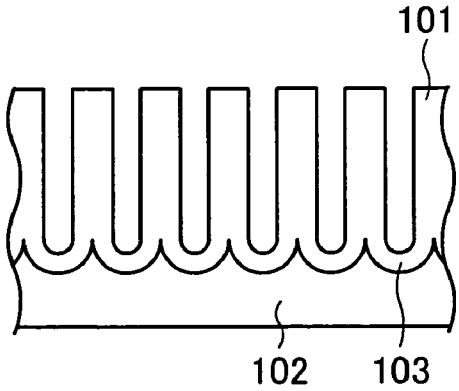
FIG. 2 is a cross sectional view schematically showing orderly porous alumina so as to illustrate a conventional art.

A preferable example of the material of the sample support surface is porous alumina. Porous alumina is an oxide layer having a large number of fine pores. Porous alumina is formed on aluminum or alloy of aluminum by anodizing the aluminum or the alloy in an electrolytic solution. By controlling the condition for anodization, it is possible to manufacture orderly porous alumina in which fine pores are orderly arrayed in a wide area. The orderly porous alumina thus obtained has the following structure: for example, as illustrated in FIG. 2, a porous alumina layer 101 in which a large number of fine pores are arrayed in one direction is formed on an aluminum (alternatively, alloy of the aluminum) layer 102 via a barrier layer 103. The barrier layer exists in FIG. 2, but the barrier layer is not necessarily requested to exist.

As described above, the porous alumina has an orderly bumpy structure and pore depth/(pore cycle−pore diameter) thereof is large. Therefore, the porous alumina is preferably applicable to the sample target of the present invention. Further, the porous alumina allows control of pore diameter, pore depth, and pore cycle by changing the condition for anodization. Therefore, the porous alumina is preferably applicable to the present invention.

The porous alumina having an orderly fine pore structure can be obtained through conventionally known methods such as: two-step anodization disclosed in H. Masuda and M. Satoh, Jpn. J. Appl. Phys., 35, pp. L126 (1996); and the method disclosed in Japanese Unexamined Patent Publication No. 121292-1998 (Tokukaihei 10-121292) in which a substrate having plural protrusions is imposed on the surface of an aluminum plate to be anodized, dents with desired pore cycle and desired positioning are formed on the surface, and then the aluminum plate is anodized.

(I-2) Method for Producing Sample Target (A)

The method for producing sample target (A) is not particularly limited as long as the method allows production of a sample target having the sample support surface with a large number of fine pores. Conventionally known methods for treating fine structures, such as anodization and lithography, can be preferably used. Among all, preferably used methods are (i) a method in which porous alumina is used as a sample support surface and the sample support surface is coated with metal and/or semiconductor so as to obtain the sample target (method example 1), (ii) a method in which porous alumina is used as a mold, a sample support surface made of other material having an identical fine pore structure as the porous alumina used as the mold is produced, and the sample support surface thus obtained is coated with metal and/or semiconductor according to necessity (method example 2), and the like. Note that, in order to produce sample target (A), in method examples 1 and 2, porous alumina whose pore diameter is 30 nm or more and less than 5 μm and whose pore depth/(pore cycle−pore diameter) is 2 or more and 50 or less is used. This allows ionization of a material whose molecular weight exceeds 10000 even in case of using no matrix in mass spectrometry.

Method 1 allows easily producing an orderly fine pore structure in which pore diameter is 30 nm or more and less than 5 μm and pore depth/(pore cycle−pore diameter) is 2 or more and 50 or less. Further, by selecting the condition for anodization, it is possible to control the pore diameter, the pore depth, and the pore cycle. Further, method 2 not only brings the same result as method 1 but also allows producing a sample support surface that is made of a desired material and that has an identical structure as porous alumina having a bumpy structure suitable for a sample support surface. Therefore, these methods are also included in the present invention.

In method example 2, the method using porous alumina as a mold was described. However, the mold is not limited to the porous alumina obtained through anodization, and a structure with fine bumps which is produced through other method may be used. In that case, too, in order to produce sample target (A), the structure used as a mold has a large number of fine pores at its front face and pore diameter is 30 nm or more and less than 5 μm and pore depth/(pore cycle−pore diameter) is 2 or more and 50 or less.

Method Example 1

This is a method for producing a sample target that is used to support a sample in ionizing the sample through laser irradiation so as to carry out mass spectrometry of the sample, and that has a sample support surface having a large number of fine pores on its face receiving the irradiated laser light. The method includes the step of using porous alumina as the sample support surface and coating the sample support surface with metal or semiconductor.

Here, porous alumina may be produced by anodizing aluminum or alloy of aluminum. Alternatively, commercially available porous aluminum may be used.

The method for producing porous alumina is not particularly limited. Conventionally known methods may be preferably used. In general, aluminum or alloy of aluminum is preferably polished, and anodized in an electrolytic solution. The electrolytic solution may be acidic or alkaline. Preferable examples of the electrolytic solution include sulfuric acid, oxalic acid, and phosphoric acid. Voltage for anodization, time for anodization, the kind and concentration of the electrolytic solution, temperature condition etc. may be determined as needed in order to obtain a sample support surface having desired pore diameter, desired pore depth, and desired pore cycle. Further, the method for polishing aluminum or its alloy before anodization is not particularly limited. Examples of the method include: electrolytic polishing of aluminum or its alloy in a mixture solution of perchloric acid and ethanol, a mixture solution of phosphoric acid and sulfuric acid, etc.; and mechanical surface polishing of aluminum or its alloy. Further, porous alumina obtained through anodization may be subjected to an etching treatment using an phosphoric acid aqueous solution, an aqueous sulfuric acid solution etc. so as to enlarge fine pores.

Further, as described above, examples of the method for producing orderly porous alumina include: two-step anodization disclosed in H. Masuda and M. Satoh, Jpn. J. Appl. Phys., 35, pp. L126 (1996); and the method disclosed in Japanese Unexamined Patent Publication No. 121292-1998 (Tokukaihei 10-121292) in which a substrate (mold) having plural protrusions is imposed on the surface of an aluminum plate to be anodized, dents with desired pore cycle and desired positioning are formed on the surface, and then the aluminum plate is anodized.

The step of coating the face of the sample support surface with metal or semiconductor is not particularly limited as long as it is the step of coating the face of the sample support surface made of porous alumina with the metal or the semiconductor described in the item (I-1) so that the metal or the semiconductor has the aforementioned thickness. The method for coating the face of the sample support surface with the metal or the semiconductor is not particularly limited and may preferably be a conventionally known method. Examples of the method include sputtering, chemical vapor deposition (CVD), vacuum deposition, electroless plating, electrolytic plating, application, noble metal varnish, organic metal thin film method, sol-gel processing and the like. These treatments may be selectively adopted depending on the kind of the metal or the semiconductor, the thickness of the coating layer, and the condition of the sample support surface to be coated. It is preferable that the method allows firmly coating the sample support surface with the metal or the semiconductor.

Method Example 2

This is a method for producing a sample target that is used to support a sample in ionizing the sample through laser irradiation so as to carry out mass spectrometry of the sample, and that has a sample support surface having a large number of pores on its face receiving the irradiated laser. The method is not particularly limited as long as the method includes the steps of: producing a negative structure by transferring a bumpy structure of porous alumina using the porous alumina as a mold; and transferring the bumpy structure by using the negative structure as a mold, so that the bumpy structure of the sample support surface has the same shape as the bumpy structure of the porous alumina.

The method is not particularly limited as long as it is "imprint" processing. Recently, in a nano technology field, there has been developed various "imprint" processing in which a fine structure of an order ranging from 1 nm to several dozens μm is used as a mold and the structure is transferred to another substance, thereby producing a DNA chip, a semiconductor device, and a fine vessel for chemical reaction.

An example of the "imprint" processing is a method disclosed in K. Nishio, M. Nakano, and A. Yokoo, Jpn. J. Appl. Phys., 42, p. L83-L85 (2003). In the method, a thin metal layer is formed on the surface of porous alumina. The thin metal layer is used as an electrode in later performed electrolytic deposition of metal. Then, monomers and polymerization initiators are filled in fine pores of the porous alumina, and the monomers are polymerized to produce polymers. Then, aluminum and alumina are dissolved and removed so as to obtain a negative structure made of the metal layer and the polymers, which is a transferred bumpy structure of the porous alumina. Using the negative structure as a mold, electrolytic deposition is performed with the metal layer serving as an electrode. Thereafter, the polymers are dissolved and removed so as to obtain a sample support surface that is made of the metal and that has on its surface a bumpy structure identical with the bumpy structure of the porous alumina.

In the method, examples of the metal used for the sample support surface made by transferring the bumpy structure of the porous alumina using the bumpy structure as a mold include the periodic table's 1A group (Li, Na, K, Rb, Cs, Fr); 2A group (Be, Mg, Ca, Sr, Ba, Ra); 3A group (Sc, Y); 4A group (Ti, Zr, Hf); 5A group (V, Nb, Ta); 6A group (Cr, Mo, W); 7A group (Mn, Tc, Re); 8 group (Fe, Ru, Os, Co, Rh, Ir, Ni, Pd, Pt); 1B group (Cu, Ag, Au); 2B group (Zn, Cd, Hg); 3B group (Al); lanthanoid (La, Ce, Pr, Nd, Pm, Sm, Eu, Gd, Tb, Dy, Ho, Er, Tm, Yb, Lu); and actinoid (Ac, Th, Pa, U, Np, Pu, Am, Cm, Bk, Cf, Es, Fm, Md, No, Lr).

The method for forming a thin metal layer on the surface of the porous alumina is not particularly limited. Examples of the method include sputtering, chemical vapor deposition (CVD), vacuum deposition, electroless plating, electrolytic plating, application, noble metal varnish, organic metal thin film method, and sol-gel processing. The thickness of the metal layer is not particularly limited, but preferably ranges from 5 nm to 100 nm, and more preferably from 10 nm to 50 nm for example.

Examples of the monomers include acrylic monomers such as methyl methacrylate and methyl acrylate. The polymerization initiator is not particularly limited, and may be a conventionally known polymerization initiator such as benzoyl peroxide. The solution for dissolving and removing aluminum and alumina is not particularly limited as long as it dissolves aluminum and alumina but does not dissolve polymers. Examples of the solution include a sodium hydroxide aqueous solution and a potassium hydroxide aqueous solution. The solution for dissolving and removing polymers is not particularly limited as long as it dissolves polymers and does not dissolve metal. Examples of the solution include acetone and chloroform.

In the aforementioned imprint processing, the method for transferring a bumpy structure of porous alumina to metal was described. However, the material of a sample support surface produced by transferring the bumpy structure of porous alumina through the imprint processing is not limited to metal. Examples of the material include a semiconductor, resin such as synthetic polymers, and ceramics. In case where the material of the sample support surface is a semiconductor, the sample support surface has high ionization efficiency even when it is not coated with metal. Further, in case where the material is resin such as synthetic polymers and ceramics, i.e., a material having no electro-conductivity, it is possible to increase ionization efficiency of the sample support surface by coating the sample support surface with metal or semiconductor. The method for transferring a bumpy structure to a semiconductor, polymers, and ceramics is not particularly limited, and may be a conventionally known method. A preferable example of the method is disclosed in H. Masuda, K. Nishio and N. Baba, Jpn. J. Appl. Phys., 31, L1775 (1992).

The semiconductor used for the sample support surface produced by transferring the bumpy structure of porous alumina using the bumpy structure as a mold is not particularly limited. Examples of the semiconductor include Si, Ge, SiC, GaP, GaAs, InP, $Si_{1-x}Ge_x$ ($0<X<1$), $SnO_2$, $TiO_2$, $In_2O_3$, and carbons.

The resin such as synthetic polymers and the ceramics may preferably be the same as the synthetic polymers and the ceramics described in the item (I-1).

In case where the material of the sample support surface produced by transferring the bumpy structure of porous alumina through the imprint processing is the resin such as synthetic polymers and the ceramics, it is preferable that the present method further includes the step of coating the face of the sample support surface with metal or semiconductor.

The step of coating the face of the sample support surface with metal or semiconductor is not particularly limited as long as it is the step of coating, with the metal or the semiconductor described in the item (I-1), the face of the sample support surface produced by transferring the bumpy structure of porous alumina through the imprint processing, so that the metal or the semiconductor has the aforementioned thickness. The method for coating the face of the sample support surface with the metal or the semiconductor is not particularly limited, and may be a conventionally known method. Examples of the method include sputtering, chemical vapor deposition (CVD), vacuum deposition, electroless plating, electrolytic plating, application, noble metal varnish, organic metal thin film method, sol-gel processing. These treatments may be selectively adopted depending on the kind of the metal or the semiconductor, the thickness of the coating layer, and the condition of the sample support surface to be coated. It is preferable that the method allows firmly coating the sample support surface with the metal or the semiconductor.

(II) Sample Target (B)

(II-1) Sample Target (B)

The sample target (B) of the present invention is a sample target that is used to support a sample in ionizing the sample through laser irradiation so as to carry out mass spectrometry of the sample, and that has a sample support surface having a large number of fine pores on its face receiving the irradiated laser light. The sample support surface has on its face a bumpy structure that is obtained in such a manner that a negative structure is produced by transferring a bumpy structure of porous alumina by using the porous alumina as a mold, and the bumpy structure is transferred by using the negative structure as a mold, so that the bumpy structure on the face of the porous alumina has the same shape as the bumpy structure of the porous alumina.

The sample target and the sample support surface have been already explained in the item (I-1).

The sample target (B) has the sample support surface having a large number of fine pores on its face receiving the irradiated laser light. The fine pores have openings on the face of the sample support surface and extend in a thickness direction of the sample support surface. The positioning of the fine pores, the shape of the fine pores, and the angle between the fine pores and the sample support surface may be regular or irregular. It is more preferable that these are regular in order to improve the function as the sample target for mass spectrometry.

The sample target (B) has a sample support surface having on its face a bumpy structure that is obtained in such a manner that a negative structure is produced by transferring a bumpy structure of porous alumina using the porous alumina as a mold, and the bumpy structure is transferred using the negative structure as a mold, so that the bumpy structure on the face of the porous alumina has the same shape as the bumpy structure of the porous alumina. The porous alumina has been already explained in the item (I-1). The porous alumina is an oxide layer having a large number of fine pores, which is formed on the surface of aluminum or alumina by anodizing the aluminum or the alumina. Therefore, pore diameter, pore depth, and pore cycle may be general ones of porous alumina, and are not particularly limited. In order to further increase the function as a sample target for mass spectrometry, it is more preferable that the pores are arrayed regularly, pore diameter is 30 nm or more and less than 5 μm, and pore depth/(pore cycle−pore diameter) is 2 or more and 50 or less. This allows ionization of a substance whose molecular weight exceeds 10000 even in case of using no matrix in mass spectrometry.

The sample support surface having on its face a bumpy structure that is obtained in such a manner that a negative structure is produced by transferring a bumpy structure of porous alumina using the porous alumina as a mold and the bumpy structure is transferred using the negative structure as a mold, so that the bumpy structure on the face of the porous alumina has the same shape as that of the bumpy structure of the porous alumina, is a sample support surface having on its face a bumpy structure that is obtained in such a manner that a negative structure is produced by transferring a bumpy structure of porous alumina and the bumpy structure is transferred using the negative structure as a mold through the method described in method example 2 of the item (I-2), so that the bumpy structure on the face of the porous alumina has the same shape as that of the bumpy structure of the porous alumina. The material of the sample support surface having on its face a bumpy structure having the same shape as the bumpy structure of the porous alumina may be metal or semiconductor, or may be resin such as synthetic polymers and ceramics, as with method example 2. In case where the material of the sample support surface is semiconductor, the sample support surface has excellent ionization efficiency even when the sample support surface is not coated with metal. Further, even in case where the material is resin such as synthetic polymers and ceramics, i.e., a material having no electro-conductivity, coating the sample support surface with metal or semiconductor increases ionization efficiency.

The metal, the semiconductor, the resin such as synthetic polymers, and the ceramics have been already explained in method example 2 of the item (I-2) and therefore explanations thereof are omitted here.

Further, in case where the material of the sample support surface produced by transferring a bumpy structure of porous alumina through the imprint processing is the resin such as synthetic polymers and the ceramics, it is preferable that the face of the sample support surface is coated with metal or semiconductor.

The metal and the semiconductor used to coat the sample support surface and the thickness of the metal and/or the semiconductor have been already explained in the item (I-1) and therefore explanations thereof are omitted here.

(II-2) Method for Producing Sample Target (B)

The method for producing sample target (B) is the same as the method explained in method example 2 of the item (I-2) and therefore explanation thereof is omitted here.

(III) Sample Target (C)

(III-1) Sample Target (C)

The sample target (C) is a sample target that is used to support a sample in ionizing the sample through laser irradiation so as to carry out mass spectrometry of the sample, and that has, as a sample support surface, a surface having a finely bumpy structure in which an interval between concaves or between convexes ranges from 1 nm to 10 μm and the depth of each concave ranges from 10 nm to 10 μm. The face of the sample support surface is coated with semiconductor.

The sample target and the sample support surface have been already explained in the item (I-1).

The sample target (C) has, as a sample support surface, a surface having a finely bumpy structure in which an interval between concaves or between convexes ranges from 1 nm to 10 μm and the depth of each concave ranges from 10 nm to 10 μm. Here, an interval between adjacent concaves or between adjacent convexes in the bumpy structure ranges from 1 nm to 10 μm. However, in order to further improve the function of the sample target for mass spectrometry, the interval ranges more preferably from 30 nm to 5 μm, further preferably from 31 nm to 1 μm, further more preferably from 33 nm to 500 nm, and most preferably from 34 nm to 300 nm. This allows good ionization of a test sample in mass spectrometry.

Further, the interval between adjacent concaves or between adjacent convexes in the bumpy structure may be regular or irregular. However, in order to improve the function of a test sample for mass spectrometry, it is more preferable that the interval is regular. In case where the interval between the concaves or between convexes is regular, variations in the concaves or the convexes are small, and therefore ionization ability is more stabilized.

The depth of the concave in the bumpy structure is approximately 10 nm or more and less than 10 μm. However, in order to further increase the function of the sample target for mass spectrometry, the depth ranges more preferably from 30 nm to 2 μm, further preferably from 50 nm to 1.5 μm, further more preferably from 70 nm to 1 μm, and most preferably from 100 nm to 1 μm. Further, the depth of the concave may be uniform or not uniform. However, in order to further increase the function of the sample target for mass spectrometry, it is preferable that the depth is uniform. In case where the depth is uniform, variations in the concaves and the convexes are small, and therefore ionization ability is further stabilized.

Specific shape of the concave is not particularly limited and may be any one. Further, the bumpy structure may be arranged so that various shaped concaves exist. However, in order to further increase the function of the sample target for mass spectrometry, it is preferable that the bumpy structure has a single-shaped concave section. Examples of the shape include a gutter, a grid made of intersecting gutters, and a hole. Further, the shape of the gutter or the hole is not particularly limited and may be any one. Examples of the shape of the gutter or the hole include a linear gutter, a curved gutter, an arcuate gutter, a circular hole, an elliptical hole, and a hole with a polygonal shape such as a triangle, a rectangle, and a pentagon.

Further, the sidewall of the concave may be perpendicular to the sample support surface or may be slant with respect to the sample support surface.

Further, the bumpy structure may be formed on the whole area of the sample support surface or may be formed on a partial area of the sample support surface.

The sample target of the present invention has a sample support surface whose face is coated with semiconductor. The semiconductor is not particularly limited. Specific examples of the semiconductor include Si, Ge, SiC, GaP, GaAs, InP, $Si_{1-x}Ge_x$ ($0<X<1$), $SnO_2$, ZnO, $In_2O_3$, combinations thereof, and carbon. More preferable examples of the semiconductor include $SnO_2$, ZnO, $In_2O_3$, and ITO that is a composite of $SnO_2$ and $In_2O_3$. These materials are oxides and are not oxidized any more, and therefore do not decrease ionization ability even when the materials are left in the air. Further, carbon has different physical properties depending on its combined state of atoms. Here, carbon is classified as semiconductor. Carbon is less likely to be oxidized in the air, too. Therefore, carbon does not decrease ionization ability even when carbon is left in the air.

The thickness of the semiconductor with which the sample support surface is coated is not particularly limited as long as the thickness does not impair the bumpy structure of the sample support surface. Specifically, the thickness preferably ranges from 1 nm or more to 200 nm or less. When the thickness of the metal does not exceed the upper limit, the bumpy structure of the sample support surface is not impaired. When the thickness is more than the lower limit, it is possible to perform effective ionization. Further, the thickness of the metal ranges more preferably from 5 nm or more to 100 nm or less, further preferably from 10 nm or more to 90 nm or less, further more preferably from 15 nm or more to 80 nm or less, and most preferably from 20 nm or more and 75 nm or less. This allows further effective ionization.

(III-2) Method for Producing Sample Target (C)

The method for producing sample target (C) of the present invention is not particularly limited as long as it is a method for producing a sample target having a sample support surface with a finely bumpy structure in which the interval between concaves or between convexes is 1 nm to 10 μm and the depth of each concave is 10 nm to 10 μm, the face of the sample support surface being coated with semiconductor. The method includes at least the step of coating the face of the sample support surface with semiconductor.

The method for coating the face of the sample support surface with semiconductor is not particularly limited. The method described in the item (I-2) is preferably used.

Further, the method for producing sample target (C) of the present invention may include, before the step of coating the face of the sample support surface with semiconductor, the step of producing a sample support surface having on its face a finely bumpy structure in which the interval between concaves or between convexes ranges from 1 nm to 10 μm and the depth of each convex ranges from 10 nm to 10 μm. The method for producing the bumpy structure may be a method for regularly and repeatedly forming a concave with a predetermined width on the face of a substrate through lithography, so that a sample support surface is formed on the face. Further, in the lithography, it is preferable that the concave is formed using an electron beam lithography device. Further, method examples 1 and 2 that are described in the item (I-2) may be preferably used.

(IV) Usage of the Present Invention (Mass Spectrometer)

The sample target of the present invention can be used as a sample table on which a sample to be analyzed is placed when performing mass spectrometry of various substances such as biopolymer, endocrine disrupter, synthetic polymer, metallic complex, and the like. Further, the sample target is effective because the sample target allows effective and stable ionization of a sample when the sample target is used in laser desorption/ionization mass spectrometry.

Therefore, the mass spectrometer using the sample target of the present invention is also included in the present invention. The sample target allows effective and stable ionization of a sample when the sample target is used particularly in a laser desorption/ionization mass spectrometer. For that reason, specifically, it is preferable that the mass spectrometer of the present invention is a laser desorption/ionization mass spectrometer that determines molecular weight of a sample by irradiating laser light to the sample and ionizing the sample.

In the laser desorption/ionization mass spectrometer, a sample to be determined is placed on the sample target. When laser light is irradiated to the sample, the sample is ionized satisfactorily.

EXAMPLES

The following more specifically explains the present invention in accordance with examples. The present invention is not limited to the examples.

Example 1

An aluminum plate whose purity was 99.99% was subjected to electrolytic polishing in a mixture solution of perchloric acid and ethanol (volume ratio was 1:4). The smooth aluminum plate was anodized in a 0.5M phosphoric acid aqueous solution for 15 minutes under conditions that a bath temperature was 17° C. and a direct current was 80V, and thus anodic porous alumina whose pore depth was 500 nm was formed. Thereafter, the sample was immersed in 10 weight % of a phosphoric acid aqueous solution for 10 minutes and subjected to a pore-diameter-enlarging treatment, and thus pore diameter of the sample was adjusted to be 100 nm. The surface of the anodic porous alumina thus obtained was coated with 50 nm of Pt through sputtering, and thus a Pt-coated porous alumina substrate whose pore cycle was 200 nm was obtained. Pore depth/(pore cycle−pore diameter) was 5.

Subsequently, using the sample target thus obtained, laser desorption/ionization mass spectrometry was performed. 5 pmol of trypsinogen whose molecular weight was 24000 was supported by the sample target, and mass spectrometry of the trypsinogen was performed using a time-of-flight mass spectrometer Voyager DE-Pro (manufactured by Applied Biosystems) through laser desorption/ionization in a linear mode. As a result, ions whose m/z was 24000 were detected.

Example 2

The surface of anodic porous alumina produced in the same manner as Example 1 was coated with 50 nm of Si through sputtering. Thus, an Si-coated porous alumina substrate whose pore cycle was 200 nm was obtained.

Subsequently, using the sample target thus obtained, laser desorption/ionization mass spectrometry was performed. 5 pmol of cytochrome C whose molecular weight was 12360 was supported by the sample target, and mass spectrometry of the cytochrome C was performed using a time-of-flight mass spectrometer Voyager DE-Pro (manufactured by Applied Biosystems) through laser desorption/ionization in a linear mode. As a result, ions whose m/z was 12360 were detected.

Example 3

An aluminum plate whose purity was 99.99% was subjected to electrolytic polishing in a mixture solution of perchloric acid and ethanol (volume ratio was 1:4). The smooth aluminum plate was anodized in a 0.3M phosphoric acid aqueous solution for 15 hours under conditions that a bath temperature was 17° C. and a direct current was 195V. Then, the oxide layer was dissolved and removed by a mixture solution of chromic acid and phosphoric acid. Then, the aluminum plate was anodized again for 2 hours under the same conditions and anodic porous alumina whose pore depth was 2 μm was formed. Thereafter, the sample was immersed in 10 weight % of a phosphoric acid aqueous solution for 30 minutes and subjected to a pore-diameter-enlarging treatment, and thus pore diameter was adjusted to 250 nm. The surface of the anodic porous alumina thus obtained was coated with 50 nm of Pt by use of an ion beam sputtering device, and thus an ideally arrayed porous alumina substrate whose pore cycle was 500 nm was obtained. Pore depth/(pore cycle−pore diameter) was 8.

Subsequently, using the sample target thus obtained, laser desorption/ionization mass spectrometry was performed. 5 pmol of cytochrome C whose molecular weight was 12360 was supported by the sample target, and mass spectrometry of the cytochrome C was performed using a time-of-flight mass spectrometer Voyager DE-Pro (manufactured by Applied Biosystems) through laser desorption/ionization in a linear mode. As a result, ions whose m/z was 12360 were detected.

Example 4

Aluminum plates whose purity was 99.99% were subjected to electrolytic polishing in a mixture solution of perchloric acid and ethanol (volume ratio was 1:4). One of the smooth aluminum plates was anodized in a 0.5M phosphoric acid aqueous solution for 11 minutes under conditions that a bath temperature was 17° C. and a direct current was 80V, and the other was anodized in a 0.3M phosphoric acid aqueous solution for 23 minutes under conditions that a bath temperature was 10° C. and a direct current was 120V. Thus were formed anodic porous alumina whose pore depth was 500 nm and pore cycle was 200 nm, and anodic porous alumina whose pore depth was 500 nm and pore cycle was 300 nm. The surface of each anodic porous alumina thus obtained was coated with 50 nm of Pt through sputtering. In case of porous alumina whose porous cycle was 300 nm, porous diameter was 100 nm and porous depth/(porous cycle−porous diameter) was 2.5. In case of porous alumina whose porous cycle was 200 nm, porous diameter was 70 nm and porous depth/(porous cycle−porous diameter) was 3.8.

Subsequently, using the sample targets thus obtained, laser desorption/ionization mass spectrometry was performed. 5 pmol of trypsinogen whose molecular weight was 24000 was supported by the sample targets, and mass spectrometry of the trypsinogen was performed using a time-of-flight mass spectrometer Voyager DE-Pro (manufactured by Applied Biosystems) through laser desorption/ionization in a linear mode. In both cases, ions whose m/z was 24000 were detected.

Example 5

An aluminum plate whose purity was 99.99% was subjected to electrolytic polishing in a mixture solution of perchloric acid and ethanol (volume ratio was 1:4). The smooth aluminum plate was anodized in a 0.3M oxalic acid aqueous solution for 15 hours under conditions that a bath temperature was 17° C. and a direct current was 40V. Then, the oxide layer was dissolved and removed by a mixture solution of chromic acid and phosphoric acid. Then, the aluminum plate was anodized again for 10 minutes under the same conditions and anodic porous alumina whose pore depth was 1 μm was formed. Thereafter, the sample was immersed in 5 weight % of a phosphoric acid aqueous solution for 40 minutes and subjected to a pore-diameter-enlarging treatment, and thus pore diameter was adjusted to 70 nm. The surface of the anodic porous alumina thus obtained was coated with 20 nm of Pt through sputtering, and thus a highly ordered porous alumina substrate whose pore cycle was 100 nm was obtained. Pore depth/(pore cycle−pore diameter) was 33.

Subsequently, using the sample target thus obtained, laser desorption/ionization mass spectrometry was performed. 5 pmol of trypsinogen whose molecular weight was 24000 was supported by the sample target, and mass spectrometry of the trypsinogen was performed using a time-of-flight mass spectrometer Voyager DE-Pro (manufactured by Applied Biosystems) through laser desorption/ionization in a linear mode. As a result, ions whose m/z was 24000 were detected.

Example 6

An aluminum plate whose purity was 99.99% was subjected to electrolytic polishing in a mixture solution of perchloric acid and ethanol (volume ratio was 1:4). The smooth aluminum plate was anodized in a 0.3M phosphoric acid aqueous solution for 15 hours under conditions that a bath temperature was 0° C. and a direct current was 195V. Then, the oxide layer was dissolved and removed by a mixture solution of chromic acid and phosphoric acid. Then, the aluminum plate was anodized again for 15 minutes under the same conditions and anodic porous alumina whose pore depth was 1 μm was formed. Thereafter, the sample was immersed in 10 weight % of a phosphoric acid aqueous solution for 60 minutes and subjected to a pore-diameter-enlarging treatment, and thus pore diameter was adjusted to 300 nm. The surface of the anodic porous alumina thus obtained was coated with 50 nm of Pt by use of an ion beam sputtering device, and thus a highly ordered porous alumina substrate whose pore cycle was 500 nm was obtained. Pore depth/(pore cycle−pore diameter) was 5.

Subsequently, using the sample target thus obtained, laser desorption/ionization mass spectrometry was performed. 5 pmol of trypsinogen whose molecular weight was 24000 was supported by the sample target, and mass spectrometry of the trypsinogen was performed using a time-of-flight mass spectrometer Voyager DE-Pro (manufactured by Applied Biosystems) through laser desorption/ionization in a linear mode. As a result, ions whose m/z was 24000 were detected.

Example 7

An aluminum plate whose purity was 99.99% was subjected to electrolytic polishing in a mixture solution of perchloric acid and ethanol (volume ratio was 1:4). Ni mold in which protrusions were orderly arrayed with a cycle of 200 nm was imposed on the surface of the smooth aluminum plate, and a finely bumpy pattern was formed. The aluminum plate having been subjected to the imprint processing was anodized in a 0.5M phosphoric acid aqueous solution for 11 minutes under conditions that a bath temperature was 17° C. and a direct current was 80V. Thus, anodic porous alumina whose pore depth was 500 nm was formed. Thereafter, the sample was immersed in 10 weight % of a phosphoric acid aqueous solution for 10 minutes and subjected to a pore-diameter-enlarging treatment, and thus pore diameter was adjusted to 100 nm. The surface of the anodic porous alumina thus obtained was coated with 50 nm of Pt by use of an ion beam sputtering device, and thus an ideally arrayed porous alumina substrate whose pore cycle was 200 nm was obtained. Pore depth/(pore cycle−pore diameter) was 5.

Subsequently, using the sample target thus obtained, laser desorption/ionization mass spectrometry was performed. 5 pmol of trypsinogen whose molecular weight was 24000 was supported by the sample target, and mass spectrometry of the trypsinogen was performed using a time-of-flight mass spectrometer Voyager DE-Pro (manufactured by Applied Biosystems) through laser desorption/ionization in a linear mode. As a result, ions whose m/z was 24000 were detected.

Comparative Example 1

An aluminum plate whose purity was 99.99% was subjected to electrolytic polishing in a mixture solution of perchloric acid and ethanol (volume ratio was 1:4). The smooth aluminum plate was anodized in a 0.3M phosphoric acid aqueous solution for 15 hours under conditions that a bath temperature was 17° C. and a direct current was 195V. Then, the oxide layer was dissolved and removed by a mixture solution of chromic acid and phosphoric acid. Then, the aluminum plate was anodized again for 2 hours under the same conditions and anodic porous alumina whose pore depth was 15 μm was formed. Thereafter, the sample was immersed in 10 weight % of a phosphoric acid aqueous solution for 60 minutes and subjected to a pore-diameter-enlarging treatment, and thus pore diameter was adjusted to 300 nm. The surface of the anodic porous alumina thus obtained was coated with 50 nm of Pt through sputtering, and thus an ideally arrayed porous alumina substrate whose pore cycle was 500 nm was obtained. Pore depth/(pore cycle−pore diameter) was 75.

Subsequently, using the sample target thus obtained, laser desorption/ionization mass spectrometry was performed. 5 pmol of cytochrome C whose molecular weight was 12360 was supported by the sample target, and mass spectrometry of the cytochrome C was performed using a time-of-flight mass spectrometer Voyager DE-Pro (manufactured by Applied Biosystems) through laser desorption/ionization in a linear mode. As a result, sample ions were not detected. Further, it was tried to ionize insulin whose molecular weight was 5800. However, insulin could not be ionized, too.

Comparative Example 2

An aluminum plate whose purity was 99.99% was subjected to electrolytic polishing in a mixture solution of perchloric acid and ethanol (volume ratio was 1:4). Ni mold in which protrusions were orderly arrayed with a cycle of 200 nm was imposed on the surface of the smooth aluminum plate, and a finely bumpy pattern was formed. The aluminum plate having been subjected to the imprint processing was anodized in a 0.5M phosphoric acid aqueous solution for 2 hours under conditions that a bath temperature was 17° C. and a direct current was 80V. Thus, anodic porous alumina whose pore depth was 70 nm was formed. The sample was subjected to a pore-diameter-enlarging treatment, and thus pore diameter was adjusted to 100 nm. The surface of the anodic porous alumina thus obtained was coated with 50 nm of Pt by use of an ion beam sputtering device, and thus an ideally arrayed porous alumina substrate whose pore cycle was 200 nm was obtained. Pore depth/(pore cycle−pore diameter) was 0.7.

Subsequently, using the sample target thus obtained, laser desorption/ionization mass spectrometry was performed. 5 pmol of cytochrome C whose molecular weight was 12360 was supported by the sample target, and mass spectrometry of the cytochrome C was performed using a time-of-flight mass spectrometer Voyager DE-Pro (manufactured by Applied Biosystems) through laser desorption/ionization in a linear mode. As a result, sample ions were not detected.

Comparative Example 3

MassPREP™ DIOS-target plate (manufactured by Waters Corporation) was pretreated with isopropanol according to the manual. Then, 10 pmol of trypsinogen whose molecular weight was 24000 was supported by the pretreated plate, and mass spectrometry of the trypsinogen was performed using a time-of-flight mass spectrometer Voyager DE-Pro (manufactured by Applied Biosystems) through laser desorption/ionization in a linear mode. As a result, sample ions were not detected.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

INDUSTRIAL APPLICABILITY

The sample target of the present invention allows a laser desorption/ionization mass spectrometry to realize excellent ionization ability and ionization of a substance with high molecular weight, even in a case of using no matrix.

The laser desorption/ionization mass spectrometry is widely adopted for mass spectrometry of various substances such as biopolymer, endocrine disrupter, synthetic polymer, metallic complex, and the like. The sample target of the present invention is effective in performing the laser desorption/ionization mass spectrometry with higher preciseness and higher stability. Therefore, the present invention has high applicability.

The invention claimed is:

1. A sample target, used to support a sample in ionizing the sample through laser light irradiation so as to carry out mass spectrometry of the sample, said sample target comprising:

a sample support surface having a large number of fine pores on its face receiving the irradiated laser light, the face receiving the irradiated laser light is coated with a metal or a semiconductor, each of the fine pores having a diameter of 30 nm or more and less than 5 μm, the number indicative of pore depth/(pore cycle−pore diameter) of each of the fine pores being 2 or more and 50 or less, each of the fine pores has a bottom, the fine pores are isolated from each other such that the sample cannot pass through an interval between the fine pores, the pore cycle is 30 nm or more and less than 5 μm, the sample support surface being made of resin or ceramics.

2. The sample target as set forth in claim 1, wherein the sample support surface is made of porous alumina.

3. The sample target as set forth in claim 1, wherein the metal is at least one of platinum (Pt) and gold (Au).

4. The sample target as set forth in claim 1, wherein the semiconductor is at least one of tin oxide ($SnO_2$), zinc oxide (ZnO), indium tin oxide (ITO), and carbon.

5. The sample target as set forth in claim 1, wherein each of the fine pores has a diameter of 30 nm or more and less than 5 μm, and the number indicative of pore depth/(pore cycle−pore diameter) of each of the fine pores is 4 or more and 50 or less.

6. The sample target as set forth in claim 1, wherein the sample has a molecular weight exceeding 10,000, and the sample target is configured to allow ionization of the sample without using a matrix.

7. A sample target, used to support a sample in ionizing the sample through laser light irradiation so as to carry out mass spectrometry of the sample, said sample target comprising:

a sample support surface having a large number of fine pores on its face receiving the irradiated laser light, the face receiving the irradiated laser light is coated with a metal or a semiconductor, the sample support surface being formed in such a manner that a negative structure is formed by transferring a bumpy structure of a porous alumina using the porous alumina as a mold, and the bumpy structure is transferred using the negative structure as a mold, so that the sample support surface has at its face a bumpy structure having a same shape as that of the bumpy structure of the porous alumina, wherein each of the fine pores has a diameter of 30 nm or more and less than 5 μm, and the number indicative of pore depth/(pore cycle−pore diameter) of each of the fine pores is 2 or more and 50 or less, each of the fine pores has a bottom, the fine pores are isolated from each other such that the sample cannot pass through an interval between the fine pores, the pore cycle is 30 nm or more and less than 5 μm, and the sample support surface is made of resin or ceramics.

8. The sample target as set forth in claim 7, wherein the metal is at least one of platinum (Pt) and gold (Au).

9. The sample target as set forth in claim 7, wherein the semiconductor is at least one of tin oxide ($SnO_2$), zinc oxide (ZnO), indium tin oxide (ITO), and carbon.

10. The sample target as set forth in claim 7, wherein each of the fine pores has a diameter of 30 nm or more and less than 5 μm, and the number indicative of pore depth/(pore cycle−pore diameter) of each of the fine pores is 4 or more and 50 or less.

11. The sample target as set forth in claim 7, wherein the sample has a molecular weight exceeding 10,000, and the sample target is configured to allow ionization of the sample without using a matrix.

12. A mass spectrometer, using a sample target as set forth in claim 1.

13. The mass spectrometer as set forth in claim 12, wherein laser light is irradiated to a sample to be analyzed and the sample is ionized, so that molecular weight of the sample is determined.

14. A mass spectrometer, using a sample target as set forth in claim 7.

* * * * *